United States Patent [19]

Foley et al.

[11] 4,185,881

[45] Jan. 29, 1980

[54] ELECTRICAL PLUG AND SOCKET ARRANGEMENT

[75] Inventors: Jeffery R. Foley, Park Orchards; Daryl J. Foley, Ivanhoe, both of Australia

[73] Assignee: Playsafe Electrics Proprietary Limited, Victoria, Australia

[21] Appl. No.: 926,015

[22] Filed: Jul. 19, 1978

[51] Int. Cl.[2] ..... H01R 13/44

[52] U.S. Cl. ..... 339/41; 200/51.07

[58] Field of Search ..... 339/40, 41, 39; 200/51.07, 51.09

[56] References Cited

U.S. PATENT DOCUMENTS

| | | | |
|---|---|---|---|
| 3,263,037 | 7/1966 | Correnti | 339/41 |
| 4,037,901 | 7/1977 | Kaszuba | 339/41 |

FOREIGN PATENT DOCUMENTS

| | | | |
|---|---|---|---|
| 162217 | 3/1955 | Australia | 339/41 |
| 1251404 | 10/1967 | Fed. Rep. of Germany | 339/41 |
| 2271680 | 12/1975 | France | 339/41 |

*Primary Examiner*—Neil Abrams

*Attorney, Agent, or Firm*—Scully, Scott, Murphy & Presser

[57] ABSTRACT

The invention relates to an electrical plug and socket arrangement. There is disclosed a plug and socket arrangement for use as a general purpose domestic electrical power outlet. The socket has a rotatable pin receiving portion which is rotatable from a first position wherein receptacles for receiving pins of the plug are electrically inactive to a second position wherein at least one receptacle is electrically active. The pin receiving portion can only be rotated to the second position when the pins are fully inserted therein because of a unique key arranged on the earth pin. The key also prevents any withdrawal of the plug in the second position, that is, when at least one of the pins is active and thus a completely child-safe plug and socket is provided.

6 Claims, 7 Drawing Figures

ELECTRICAL PLUG AND SOCKET ARRANGEMENT

Figure 1:
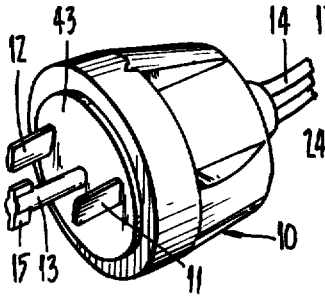

This invention relates to electrical plug and socket arrangements and in particular to a plug and socket arrangement incorporating a switching function enabling electrical connection to be made between the plug and socket when the plug is inserted into the socket. For example, the invention is applicable to a general purpose electrical power outlet (GPO) suitable for domestic use but is clearly not limited thereto and could be applied to many other situations.

Commonly a GPO comprises a fixed socket member having pin receptacles, a socket member having pins adapted for insertion in said receptacles and a separate toggle-type switch mounted on a facia panel adjacent to said socket member. Such a GPO is a standard device throughout Australia where a three wire system is employed, that is, active neutral and earth wires are provided. Such a GPO is also commonly used in two wire systems.

Several disadvantages or dangers have been recognized with the above described GPO, the most serious of which involves the ability of children to insert electrically conductive objects into the pin receptacles when a plug is not connected thereto and actuate the switch to the 'on' position, in which case they would be most likely to receive a fatal electric shock. This problem has been long since recognized and several attempts to overcome it have been made in the past. Australian patent specifications Nos. 29,205/30 and 133,918 describe two such attempts.

The plug and socket described in 29,205/30 involves turning of the plug as it is inserted in the socket and electrical contact is only established between the plug and socket when the plug is fully inserted. The need for a separate switch is thus obviated and there are no conventional type pin receptacles for receiving conductive objects to cause the aforementioned fatalities. A cylindrical extended portion of the plug in fact fits into the socket and electrical contacts for the plug are on the extended portion. There are however disadvantages in the plug and socket described, in that it is relatively complex and hence would be costly to manufacture and, more importantly, it does not completely solve the problem of children being able to contact live terminals in the socket. The latter problem is due to the fact that when the plug is removed a spring-biased cover plate inside the socket serves to block or close a hole in which the extended portion of the plug fits when the two parts are engaged. It is conceivable that the plate could be forced inwardly against the spring bias with some device other than the plug without much effort in which case it would then be possible for a child to contact a live terminal.

Similarly with the arrangement described in 133,918 it would be possible for a child to contact a live terminal in the socket. In this device the backing plate 10 shown in the drawings could be pivoted or rotated in a clockwise direction with means other than the pins of the plug. For example a screw driver, pencil or other elongated device could be inserted in holes 12 or 13 (FIG. 4) to cause said plate to pivot in a clockwise direction. Once past the dead centre position of the toggle the holes 12 and 13 will snap to a position exposing socket contacts 3 and 4; at least one of which will be "alive".

Thus without the plug electrically connected to the socket it is again possible to expose a live contact.

Accordingly it is an object of the present invention to provide an improved plug and socket arrangement which avoids one or more of the aforementioned disadvantages.

In one form the invention provides an electrical plug and socket arrangement including a pin receiving member having a plurality of pin receptacles and being mounted in a body part of said socket for movement with respect to said body part, said pin receptables providing openings in a front face of said socket and being adapted to receive a respective pin of said plug, one of said receptacles being an active pin receptacle which, in a first position of said member relative to said body is, in use, electrically inactive, and in a second position of said member relative to said body is, in use, electrically active so as to electrically energise a said pin inserted therein, said movement of said member from said first position to said second position only being possible by insertion of at least one of said pins fully into its respective receptacle thereby necessitating full insertion of said plug into said socket, and withdrawal of said plug from said position of full insertion being possible only in said first position of said member.

Figure 4:
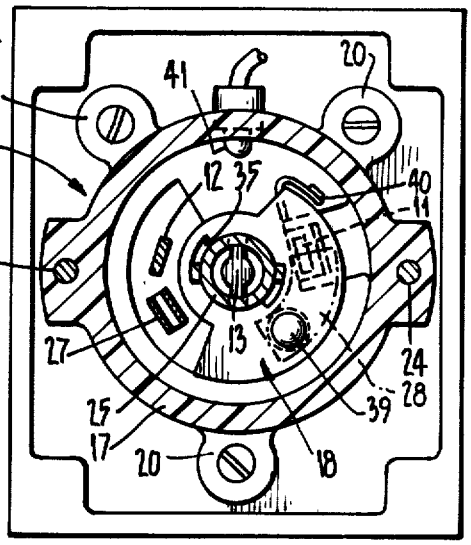
Figure 7:
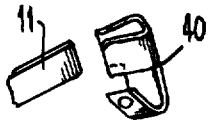
Figure 6:
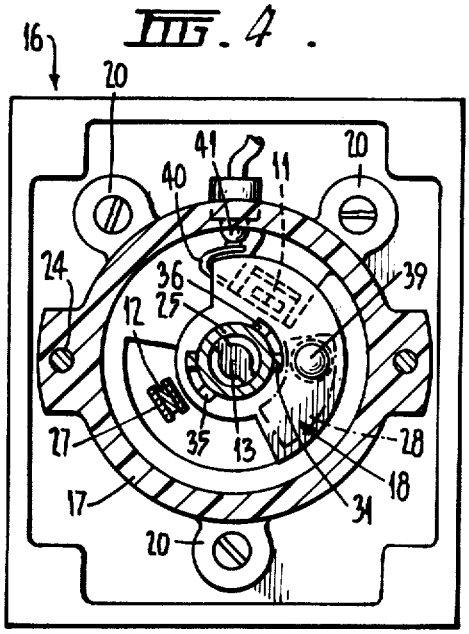
Figure 3:
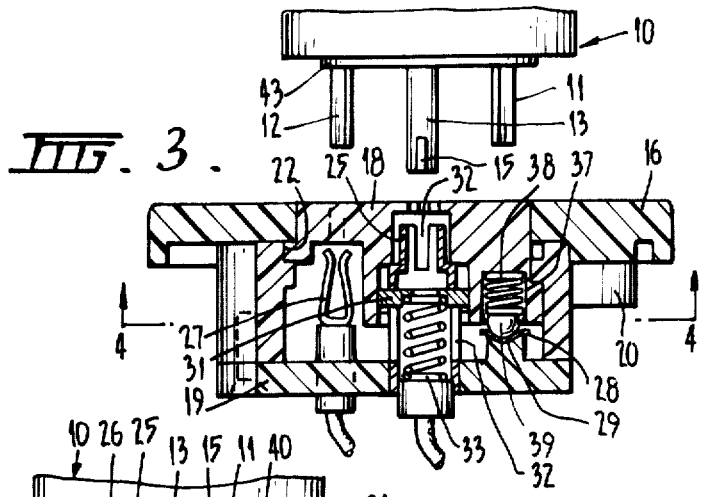
Figure 5:
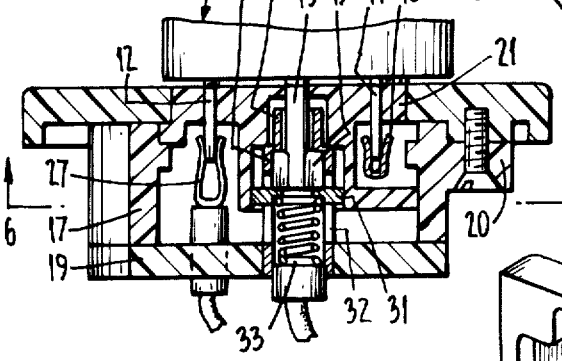
Figure 2:
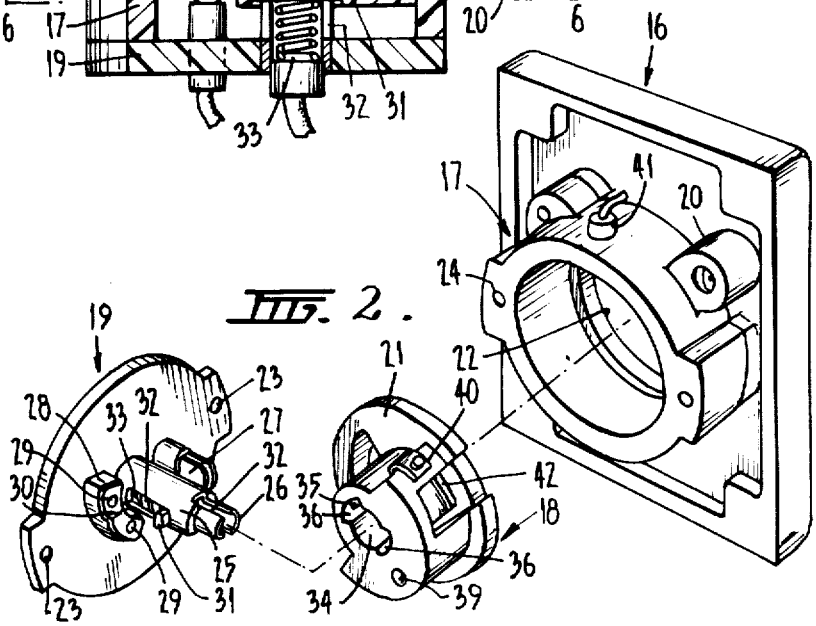

In order that the invention may be more readily understood one particular embodiment will now be described with reference to the accompanying drawings wherein FIG. 1 is a perspective view of a plug of a plug and socket arrangement according to the embodiment, FIG. 2 is an exploded perspective view of the components constituting the socket of the embodiment, FIG. 3 is a section through the socket of FIG. 2 in the assembled condition, FIG. 4 is a section along the line 4—4 of FIG. 3, FIG. 5 is a section through the socket of FIG. 2 in the assembled condition with the plug inserted and rotated to the 'on' position, FIG. 6 is a section along the line 6—6 of FIG. 5 and FIG. 7 is a perspective view of one of the contacts of the socket of FIG. 2.

As shown in FIG. 1, the plug 10 has an active pin 11, a neutral pin 12 and an earth pin 13 which connect to the respective wires of a cord 14 inside the plug. The active and neutral pins are substantially the same as the corresponding pins on a conventional three-pin plug as used in Australia. However, the location and configuration of the earth pin 13 differs significantly from that of a conventional plug as used in Australia. It should be noted that the earth pin 13 has a circular cross-section and protrusions 15 on the end thereof. The protrusions 15 provide a key arrangement on the end of the earth pin for actuating the switch as will become apparent hereinbelow.

Referring now to FIG. 2, it can be seen that the socket consists essentially of four separate components, namely, a front facia plate 16, a body part 17, a rotatable inner part 18 and a back plate 19. The four essential components constituting the socket may be moulded in a plastics material or other suitable insulating material. The body part 17 is attached to the front facia plate 16 by means of screws which pass through respective boss portions 20. The rotatable inner part 18 is located in the body part 17 and is retained therein by means of the disc portion 21 which is retained around its circumference within a groove 22 defined by the body part 17 and the front facia plate 16. The part 18 is thus capable of rotational movement within the body part 17.

The back plate 19 is attached to the body part 17 by screws (not shown) which pass through holes 23 in the back plate 19 and are received in threaded holes 24 in the body part 17. The back plate 19 has mounted thereon a generally cylindrical earth pin receptacle 25 which has a neck portion 26 of lesser diameter. The earth pin receptacle 25 is formed from metal so as to be conductive and is adapted to receive an earth wire from the rear of the socket assembly as shown in FIGS. 3 and 5. The back plate 19 also has mounted thereon a neutral pin receptacle 27 and a plate member 28 which has a pair of hemispherical indentations 29 separated by a ridge 30. The purpose of the plate member 28 will become apparent hereinbelow.

The earth pin receptacle 25 incorporates a cross member 31 which projects outwardly through elongated slots 32 which extend part way along the length of a cylindrical body part and the cross member 31 is biased in a direction towards the neck portion 26 by means of a compression spring 33. It should be noted that the neck portion 26 also has diametrically opposed elongated slots 32 extending along the length thereof. In the assembled condition of the socket the earth pin receptacle 25 extends into a bore 34 through the rotatable inner part 18. The bore 34 has diametrically opposed axial grooves 36 extending part way along the length thereof from the rear most end, that is, the end directed towards the back plate 19. Also short circumferential cut-outs 35 are provided in the rear most face of the part 18 to adjoin with the axial grooves 36. Thus when the earth pin receptacle 25 extends into the bore 34 the ends of the cross member 31 are located in the elongated slots 36 to prevent the inner part 18 from rotating. It is only when the cross member 31 is forced against the spring 33 to a position wherein the ends of the cross member 31 are located in the slots 36 where they adjoin the cut-outs 35 that the inner part 18 can be rotated. In other words the combination of the slots 36 and cutouts 35 means that the slots 36 are stepped wider towards the rear of part 18 and when the cross-member 36 is in this wider portion it allows limited rotational movement of the part.

The rotatable inner part 18 has a hole 37 incorporating a further compression spring 38 and a spherical ball 39 which protrudes from the hole. The spring 38 and ball 39 are best seen in FIG. 3. In the assembled condition the protruding part of the ball 39 is located in one or the other of indentations 29 in plate member 28. Rotation of the part 18 causes the protruding part of ball 39 to move over the ridge 30 from one indentation 29 to the other. This provides a positive action for the switching function which will be described hereinbelow. Once assembled rotational movement of the part 18 is limited by the circumferential length of the cut-outs 35 which is related to the spacing between the indentations 29 such that when the cross member 31 is located in the slot 32 the ball 39 is in one indentation whereas when the cross member 31 has reached the extremity of the cut-outs 35 (see FIG. 6) the ball 39 is located in the other of the indentations 29. The inner part 18 further includes an active pin receptacle 40 located in a cavity in the side of the inner part 18. The active pin receptacle 40 is shown in FIG. 7 and comprises a U-shaped part for contacting the active pin and a contact portion which extends outside the cavity to a position enabling contact with an active terminal 41 arranged on the body part 17 and adapted to receive an active wire as shown in FIGS. 4 and 6. The front or outwardly directed face (not shown) of the member 18 has an appropriate aperture for receiving each of the three pins of the plug 10. The aperture for receiving the earth pin 13 is appropriately shaped, is in the rotational centre of the part 17 and provides access to the bore 34. The aperture for the active pin 11 can be seen in FIG. 2 where it is labelled with reference 42. The aperture 42 provides access to the cavity in the side of the part 18 and is aligned with the receptacle 40. In the assembled condition the cavity containing the receptacle 40 is essentially fully enclosed as the inner wall of the body part 17 combines with the part 18 to close the cavity. The aperture (not shown) for neutral pin 12 provides access to the inside of the body part 17 so that neutral pin 12 may assume the position shown in FIG. 4 when the plug and socket arrangement are in an off condition.

The plug and socket arrangement described above is suitable for a three wire domestic installation as used in Australia. In use the front facia plate 16 is mounted in a wall such that the body part 17 projects rearwardly through the wall to a cavity therein. In use the plug 10 is connected to the socket by inserting the pins through their respective apertures in the front face of rotatable inner part 18. Once inserted the pins of the plug 10 are in the position shown in FIG. 4 wherein the active pin 11 engages the active pin receptacle 40, the neutral pin 12 does not engage anything and the end of the earth pin 13 is initially located in the neck portion 26 of the receptacle 25. When in the neck portion 26 the protrusions 15 are engaged in the longitudinal slots in the neck portion. In this position it is not possible for the inner part 18 to be rotated because the cross member 31 is located in the elongated slots 36. In order to be able to rotate the part 18 it is necessary to push the plug 10 fully into the socket such that the cross member 31 is forced against the spring 33 to a position wherein its ends are capable of rotating in the cut-outs 35. In order to achieve this a boss 43 on the plug 10 is located in a corresponding cavity (not shown) formed in the front of the plate 16. The cavity results from the fact that the front face of the part 18 is rebated with respect to the front face of the plate 16. This means that when the plug is fully pushed into the socket it is not possible to insert anything therebetween for the purpose of contacting an active pin.

With the plug in the fully inserted position it is possible to rotate the plug and thus cause the inner part 18 to rotate by virtue of the fact that the active and neutral pins extend through corresponding apertures in the disc portion 21 of the part 18. The rotation is limited when the ends of the cross member 31 reach the ends of the respective cut-outs 35. In the course of rotation the ball 39 moves over the ridge 30 into the other of the indentations 29. Such movement causes a snap-action of the device. In the rotated position the pins assume the orientation shown in FIG. 6 wherein the neutral pin engages the receptacle 27, the active pin is fully engaged in the receptacle 40 and the earth pin has its protrusions 15 located in the body part of the receptacle 25. It should be noted that the protrusions 15 are then out of alignment with the slots of the neck portion and thus withdrawal of the plug is prevented. Furthermore, the contact part of the receptacle 40 now engages the active terminal 41 to establish an electrical circuit through the plug and socket arrangement. The plug can only be withdrawn by counter rotation to a position wherein the protrusions 15 align with the slots of the neck portion 26 of the earth pin receptacle 25. Once in this position, the plug is sprung outwardly from the socket a short distance due to the spring 33, in which position it is still supported by the socket but is in an inactive condition. In other words in order to withdraw the plug it is necessary to rotate it to the position shown in FIG. 4 wherein all pins are inactive.

It should be apparent from the embodiment described above that the invention provides an improved electrical plug and socket arrangement wherein it is virtually impossible to make contact accidentally with a live terminal or contact from the front of the facia plate 16. For example, insertion of any form of conductive device through the active pin aperture 42 will only enter the cavity or chamber containing the active pin receptacle 40. In the normal or off condition this receptacle is non-active and can only be made active by rotation of the inner part 18 which in turn can only be affected by means of the plug 10 when fully inserted in the socket or by some other means substantially identical to the earth pin 13 which would require insertion into the earth pin receptacle 25. Thus for someone to accidentally receive an electric shock from the arrangement it would be necessary for firstly insert a device in the earth pin receptacle to enable rotation of the inner part 18 to the on position and then insert some conductive member in the active pin aperture 42. Such a chain of events would certainly be beyond the competence of a child and thus the arrangement according to this invention provides an improved plug and socket which is much superior from the safety aspect. Furthermore, the device is relatively simple and thus would be economical to manufacture.

Whilst one particular embodiment of the invention has been described in detail hereinabove it should be appreciated that many modifications and variations may be readily effected. For example, the plug and socket arrangement could be adapted for two wire applications wherein it may only be necessary to have two pins on the plug and correspondingly two receptacles in the socket. Furthermore, the shape of the earth pin may be varied and other forms of interlocking between the plug and socket are envisaged. Also whilst the switching operation is effected by rotating the plug it is readily conceivable that such operation could be effected by pivotal movement of an inner part of the socket arrangement or even sliding movement of a suitable inner part. Essentially it is only necessary that whatever movement is necessary to actuate the socket from a condition wherein the active receptacle becomes alive is effected by insertion of another pin in a receptacle which is normally not active; said other pin having a unique shape so as to facilitate actuation and retention of the pin in its receptacle when the arrangement is actuated to the on condition.

Of course the principles of this invention can be applied to arrangements other than a GPO as it is readily conceivable that the socket could be modified so as to be suitable for use on an extension cord. Thus the invention could provide an improved plug and socket arrangement suitable for extension cords. The scope of the invention will be evident from the accompanying claims which form part of the disclosure of this specification.

We claim:

1. An electrical plug and socket arrangement including a body part of the socket, a pin receiving member having a plurality of pin receptacles and being mounted in said body part for limited rotational movement with respect to said body part, said pin receptacles providing openings in a front face of said socket and each being adapted to receive a respective pin of said plug, one of said receptacles being an active pin receptacle which, in a first position of said member relative to said body is, in use, electrically inactive, and in a second position of said member relative to said body is, in use, electrically active so as to electrically energise a said pin inserted therein, one of said pins being an earth pin which is located along the axis of rotation of said member and said movement of said member from said first position to said second position being possible only by insertion of said earth pin fully into its respective receptacle thereby necessitating full insertion of said plug into said socket, insertion and withdrawal of said plug to and from said position of full insertion being possible only in said first position of said member, and said earth pin being a special pin having a unique key configuration so as to co-operate with its respective receptacle to enable said movement only when in a fully inserted position therein, said co-operation also serving to retain said earth pin in said fully inserted position except when said member is in said first position.

2. An arrangement as defined in claim 1 wherein said key configuration comprises a generally tee-shaped end on said earth pin formed by a cross-piece which extends normal to the axis of the earth pin, said receptacle for said earth pin including a cylinder coaxial with said axis, which cylinder is mounted on said body part and has a slotted end for receiving said end of said earth pin such that said earth pin is interlocked therewith except when said cross-piece and said slot are aligned, said cylinder incorporating a cross-member having ends which project through diametrically opposed axially extending slots in the cylinder enabling said cross-member to slide axially within said cylinder, said cross-member being spring biased towards the slotted end of the cylinder so as to force the end of the earth pin from the cylinder when said cross-piece and said slot in the end of the cylinder are aligned and the projecting ends of said cross-member co-operating with said pin receiving member to prevent movement from said first to said second position except when said end of said earth pin is fully inserted in said cylinder and to allow limited rotational movement of said pin receiving member when said end is fully inserted.

3. An arrangement as defined in claim 2 wherein said active pin receptacle is adapted to prevent access to any electrically active part within said body part when said member is in said first position.

4. An arrangement as defined in claim 3 wherein said active pin receptacle comprises a chamber including therein an electrical contact member for making contact with said active pin, said contact member extending from said chamber to the inside of said body part and being adapted to make electrical contact with a fixed active terminal inside said body part when said member is rotated to said second position thus providing a bridge member between said active pin and fixed active terminal.

5. An arrangement as defined in claim 4 wherein one of said receptacles is a neutral pin recpetacle adapted to receive a neutral pin of said plug, said neutral pin making no electrical contact in said neutral pin receptacle when said member is in said first position but slidably engaging a neutral contact within said body as said member is moved to said second position.

6. An arrangement as defined in claim 5 wherein a spring biased ball is disposed between said pin receiving member and said body, said ball being adapted to move between adjacent indentations in a plate member upon said movement which indentations are separated by a ridge so as to provide positive movement between said first and second positions and positive location of said member in one or the other said positions.

* * * * *